United States Patent [19]

Gilman,Jr. et al.

[11] Patent Number: 4,933,273

[45] Date of Patent: Jun. 12, 1990

[54] PHOTOGRAPHIC ELEMENT AND EMULSION HAVING ENHANCED SENSITOMETRIC PROPERTIES AND PROCESS OF DEVELOPMENT

[75] Inventors: Paul B. Gilman,Jr., Penfield; Thaddeus D. Koszelak, Rochester; Anthony Adin, Rochester; Roland G. Willis, Rochester, all of N.Y.

[73] Assignee: Eastman Kodak Company, Rochester, N.Y.

[21] Appl. No.: 278,990

[22] Filed: Dec. 2, 1988

[51] Int. Cl.[5] ..... G03C 5/32

[52] U.S. Cl. ..... 430/597; 430/598; 430/585; 430/588; 430/579; 430/264; 430/592

[58] Field of Search ..... 430/598, 597, 264, 585, 430/588, 579, 592

[56] References Cited

U.S. PATENT DOCUMENTS

| | | | |
|---|---|---|---|
| 2,892,715 | 6/1959 | Hunsberger | 430/439 |
| 3,772,030 | 1/1976 | Gilman, Jr. | 430/606 |
| 3,935,010 | 1/1976 | Gilman, Jr. | 430/597 |
| 4,011,081 | 3/1977 | Gilman et al. | 430/406 |
| 4,025,347 | 5/1977 | Beretta et al. | 430/597 |
| 4,323,643 | 4/1982 | Mifune et al. | 430/598 |
| 4,650,746 | 3/1987 | Simson et al. | 430/598 |

OTHER PUBLICATIONS

J. Photographic Science 31 185 (1983).

Trans. Soc. Motion Picture Engineers, vol. 12, p. 1096 (1928) M. L. Dundon et al.

*Primary Examiner*—Paul R. Michl

*Assistant Examiner*—Thorl Chea

*Attorney, Agent, or Firm*—Joshua G. Levitt

[57] ABSTRACT

A photographic element and emulsion are described which comprise a negative working silver halide emulsion layer, a hydrazine compound nucleating agent and an electron accepting antifogging dye. Enhanced sensitometric properties are obtained. A process for developing such element or emulsion is also described.

39 Claims, No Drawings

PHOTOGRAPHIC ELEMENT AND EMULSION HAVING ENHANCED SENSITOMETRIC PROPERTIES AND PROCESS OF DEVELOPMENT

The present invention relates to improved photographic element and emulsion. More particularly, this invention relates to both a photographic element and a photographic emulsion having enhanced sensitometric properties and to a process for developing same.

Hydrazine type compounds have been used as nucleating agents to enhance the photographic response of silver halide emulsions, particularly to increase contrast values thereof. For example, U.S. Pat. Nos. 2,419,975; 4,224,401; 4,237,214 and 4,272,606 relate to the use of hydrazine type compounds which can be incorporated in photographic elements or employed in developer solutions. The silver halide emulsions described in these patents may be chemically sensitized.

However, when hydrazine type compounds are used with silver halide emulsions, particularly with emulsions which have been chemically sensitized, the usual high level of discrimination between a desirable image and fog becomes much less perceptible.

Attempts to reduce fog in silver halide emulsions containing hydrazine type compounds are described in U.S. Pat. No. 2,892,715. Such attempts recognize the use of conventional antifogging agents, such as for example 6-nitrobenzimidazole nitrate, and also the use of a combination of sodium xylene sulfonate and octylphenoxy polyoxyethylene ethanol with conventional antifoggants.

Notwithstanding attempts to reduce fog formation caused by hydrazine type compounds the problem of unwanted fogging in silver halide emulsions containing hydrazine type compounds is still basically unresolved, particularly with respect to silver halide emulsions which are chemically sensitized.

It is therefore an object of the present invention to provide for the reduction, or the substantial elimination, of undesirable fogging in silver halide emulsions, particularly in chemically sensitized silver halide emulsions, comprising hydrazine type compounds.

It is also an object of this invention to provide for the reduction, or substantial elimination, of undesirable fogging in sensitized silver halide emulsions by processing such emulsions in the presence of hydrazine compounds.

Hereinafter, use of the term "hydrazine" or "hydrazine type" compound is intended to include both hydrazine and hydrazide compounds, as well as salts and derivatives thereof, which are capable of functioning as nucleating agents to enhance the contrast and photographic speed of silver halide emulsions.

The present invention provides a photographic element comprising a support having thereon a chemically sensitized, negative working photographic silver halide emulsion layer and a hydrazine compound nucleating agent wherein said element also comprises an electron accepting antifogging dye which has a reversible reduction potential more positive than about −0.8 volt.

The present invention also provides a process for developing an imagewise exposed, chemically sensitized, negative working photographic silver halide emulsion comprising an electron accepting antifogging dye having a reversible reduction potential more positive than about 31 0.80 volt wherein processing is carried out in an alkaline solution comprising a hydrazine compound nucleating agent.

The present invention also provides a chemically sensitized, negative working photographic silver halide emulsion comprising a hydrazine compound nucleating agent and an electron accepting antifogging dye having a reversible reduction potential more positive than about −0.80 volt.

The electron accepting antifoggin dye (EAD) which is suitable for use in this invention has a reversible reduction potential which is more positive than about −0.80 volt. Preferably, such EDA has a reversible reduction potential of from about −0.10 to about −0.80 volt.

Measurement of reversible polarographic reduction potential is accomplished by the method of J. Lenhard in Journal of Imaging Science, 30 No. 1, 27–35 (1986), which description is incorporated herewith by reference.

Applicants have found that the combination of an EAD, as defined above, with a fogging or a nucleating speed-increasing or contrast-enhancing hydrazine compound, provides improved photographic speed in chemically sensitized silver halide emulsions without a concomitant increase in fog.

The EAD compound used in this invention is believed to be a deep electron trapping agent and, as such, is able selectively to trap electrons away from chemical sensitization centers on silver halide grains. This function of selective electron trapping is dependent upon the reduction potential which, as noted above, must be more positive than about −0.80 volt.

The concentration of an EAD which is useful in this invention depends at least in part upon its reduction potential. It has been found that as the reduction potential becomes less negative, moving for example from a value of about −0.80 to about −0.40 volt, the amount of EAD required to reduce fog caused by the hydrazine type compound decreases. This effect is demonstrated in Table I below.

In general, from about $10^{-8}$ to about $10^{-3}$ mol of EAD per mol of silver has been found to be capable of imparting desired speed increases while maintaining low levels of fog. A preferred range of EAD is from about $10^{-7}$ to about $10^{-4}$ mol per mol of silver to achieve the desired results without causing desensitization of the silver halide. As can be seen from results presented below, particular EAD compounds function very well at low levels of concentration.

Mixtures of EAD compounds and of hydrazine type compounds can be employed to achieve the desired speed increases with low fog levels.

EAD compounds which have been found to be useful in this invention include electron trapping and desensitizing dyes which are already known in the art. References which describe such dyes and their preparation include U.S. Pat. Nos. 3,772,030 and 4,011,081 and J. Photographic Science, 31, 185 (1983). Accordingly, preparation of such compounds can be accomplished by known synthetic procedures.

Representative EAD compounds suitable for use in this invention include:

EAD-1
1,1'-dimethyl-2,2'-(4-methoxyphenyl)-3,3'-

-continued
indolocarbocyanine bromide
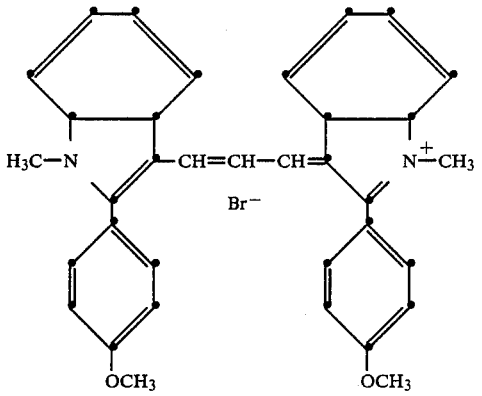
EAD-2
1,1′-dimethyl-2,2′-diphenyl-3,3′-indolo-
carbocyanine bromide
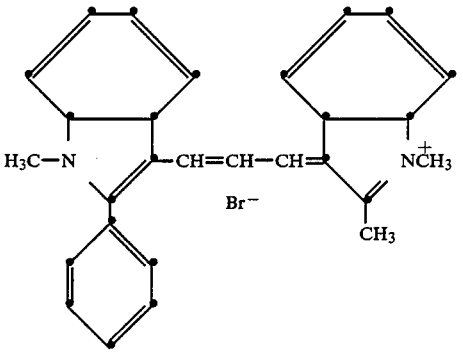
EAD-3
6,6′-7,7′-tetrachloro-1,1′,3,3′-tetraphenyl-
1H-imidazo[4,5-b]quinoxalinocarocyanine
p-toluenesulfonate
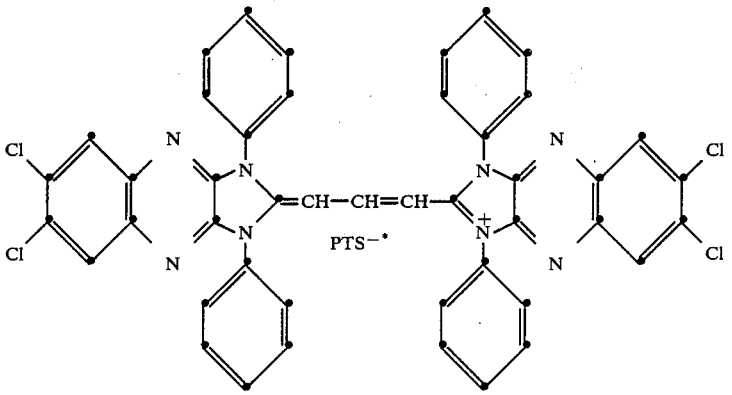
EAD-4
5-chloro-3-methyl-2-[2-(1-methyl-2-phenyl-1H-
indol-3-yl)ethenyl]-6-nitrobenzothiazolium
p-toluenesulfonate -continued

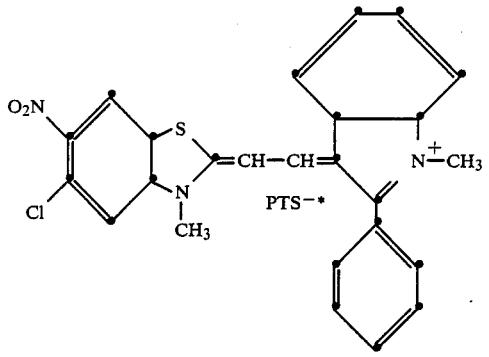

EAD-5
1,1'-dimethyl-2,2',8-triphenyl-3,3'-indolocarbocyanine perchlorate

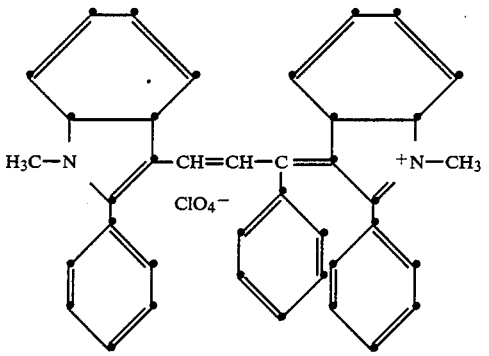

EAD-6
3-ethyl-2-[2-[1-methyl-2-(2-pyridyl)-1H-indol-3-yl]ethenyl-6-nitrobenzothiazolium p-toluenesulfonate p-toluenesulfonic acid

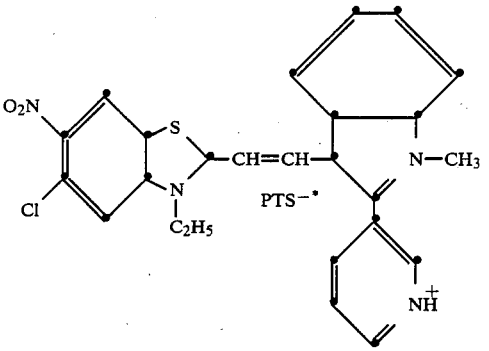

EAD-7
1,1'-dibutyl-4,4'-bipyridinium dibromide

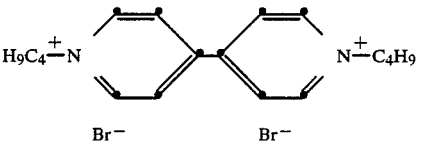

*PTS = p-toluenesulfonate

The hydrazine compound nucleating agent suitable for use in this invention, coated in combination with an EAD compound or employed separately in a developer solution, is a nonselective reducing agent, that is the hydrazine compound is capable of reducing both exposed and unexposed silver halide grains. Such nucleating agents are well known and can be any of a number of agents already recognized as being capable of enhancing the speed or contrast of negative working silver halide.

Typical but not limiting examples of such hydrazine compound nucleating agents include those described in U.S. Pat. Nos. 2,419,975; 4,221,857; 4,224,401; 4,237,214; 4,243,739; 4,272,606; 4,323,643; 4,358,530; 4,269,929; 4,540,655; 4,560,638; 4,650,746; 4,681,836 and 4,722,884, and also in pending U.S. pat. application Ser. Nos. 167,814 of Looker et al, filed Mar. 14, 1988 and 200,273 of Machonkin et al, filed May 31, 1988, which disclosures are incorporated herein by reference.

Preferred hydrazine compound nucleating agents include those disclosed in U.S. Pat. No. 4,650,746 which have the structural formula:

$$R^1-NHNHC(=O)H$$

wherein;

R is a phenyl nucleus having a Hammet sigma value-derived electron withdrawing characteristic of less than +0.30;

also those disclosed in U.S. Pat. No. 4,323,643 which have the structural formula:

$$R^2-N(R^3)-C(=O)-N(R^4)-X-NHNHC(=O)H$$

wherein;

$R^2$ and $R^3$ represent hydrogen, an aliphatic group, an aromatic group or a heterocyclic group;

$R^4$ represents hydrogen or an aliphatic group and

X is a divalent aromatic group;

and also the hydrazine compounds described in U.S. Pat. No. 4,681,836 having the structural formula:

$$R^5-NHNHC(=O)H$$

wherein;

$R^5$ is an aliphatic or an aromatic group.

The electron withdrawing or electron donating characteristic of an $R^1$ phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron withdrawing substituents are assigned negative sigma values. For example, in one preferred form $R^1$ can be a phenyl group which is unsubstituted. The hydrogen attached to the phenyl ring each have a Hammett sigma value of 0 by definition. In another form the phenyl nuclei can include halogen ring substituents.

The hydrazine compound nucleating agents which can be employed in this invention are well known in the art and need not be described in detail. Generally such compounds can be obtained by reacting formic acid, or a salt thereof, with a hydrazine compound, for example a phenylhydrazine.

Specific hydrazine compounds include the following:

H-1

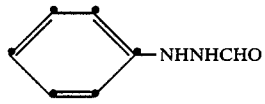

H-2

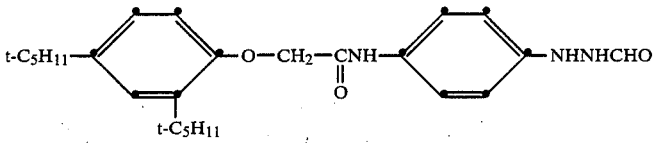

H-3

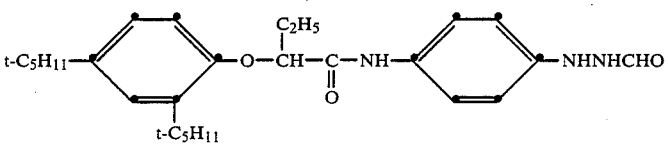

H-4

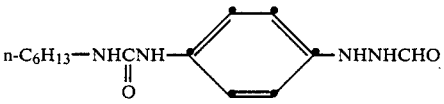

H-5

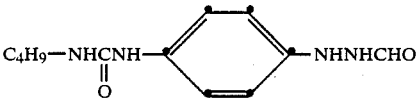

-continued

H-6

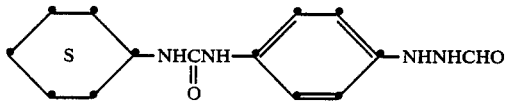

H-7

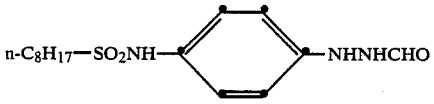

H-8

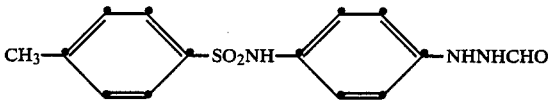

H-9

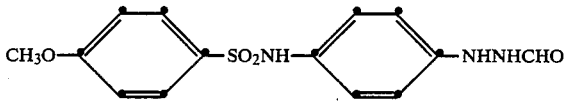

H-10

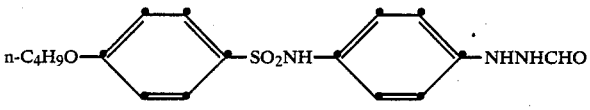

H-11

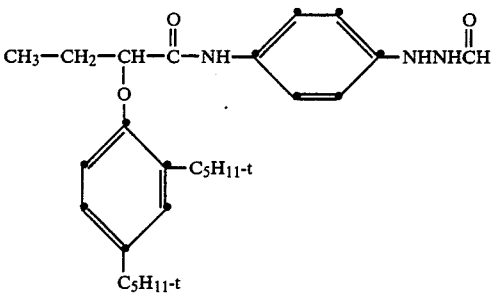

The hydrazine compounds can be employed in the described photographic elements and emulsions in a concentration of from about $10^{-4}$ to about $10^{-1}$ mol per mol of silver. A preferred quantity of the hydrazine compound is from about $5\times10^{-4}$ to about $5\times10^{-2}$ mol per mol of silver. Optimum results are obtained when the hydrazine compound is present in a concentration of from $8\times10^{-4}$ to about $5\times10^{-3}$ mol per mol of silver.

The hydrazine compound can be incorporated in a photographic silver halide emulsion layer or, alternatively, in another hydrophilic colloid layer. Preferably, the hydrazine is coated in the same layer which contains the EAD compound. The compound may be added to the photographic emulsion at any stage of preparation from the beginning of the chemical ripening to just before coating of the emulsion.

When the hydrazine compound nucleating agent is incorporated in a developer solution the amount of such compound to be used is from about $10^{-5}$ to about $10^{-2}$ mol thereof/liter of developer solution. Equally satisfactory results are obtained by incorporating the hydrazine compound in the photographic element or emulsion or in the alkaline developer solution as is demonstrated hereafter by test results.

Silver halide emulsions used in this invention contain a vehicle in addition to silver halide grains. The proportion of vehicle can be widely varied, but typically is within the range of from about 20 to 250 grams per mol of silver halide. Excessive vehicle can have the effect of reducing maximum density and consequently also reducing contrast. Thus for contrast values of 10 or more it is preferred that the vehicle be present in a concentration of 250 grams per mol of silver halide or less. The specific vehicle materials present in the emulsion and any other layers of the photographic elements can be chosen from among conventional vehicle materials. Preferred vehicles are water permeable hydrophilic colloids, especially gelatin, employed alone or in combination with extenders such as synthetic polymeric peptizers, carriers, latices, and binders. Such materials are more specifically described in *Research Disclosure*, Vol. 176, Dec. 1978, Item 17643, Section IX. Vehicles are commonly employed with one or more hardeners, such as those described in Section X.

The silver halide present in the described photographic elements and emulsions may have any halide composition. For example, silver chloride, silver bromide, silver chlorobromide and silver bromoiodide are all suitable for use with the present invention. Conventional chemical sensitizing agents can be employed. These include compounds of sulfur, gold, selenium, copper, rhodium, iridium and mixtures thereof. A preferred mixture is sulfur and gold.

Emulsions include those having silver halide grains of any conventional geometric form (e.g., regular octahedral or, preferably, cubic crystalline form) and can be prepared by a variety of techniques —e.g., single-jet, double-jet (including continuous removal techniques), accelerated flow rate and interrupted precipitation techniques, as illustrated by Trivelli and Smith, The Photographic Journal, Vol. LXXIX, May, 1939, pages 330–338; T. H. James The Theory of the Photographic Process, 4th Ed., Macmillan, 1977, Chapter 3; *Research Disclosure*, Vol. 149, Sept. 1976, Item 14987; *Research Disclosure*, Vol. 225, Jan. 1983, Item 22534; as well as U.S. Pat. Nos. 2,222,264; 3,650,757; 3,790,387 and 3,917,485; German OLS No. 2,107,118; and U.K. Pat. Nos. 1,335,925; 1,430,465 and 1,469,480. Double-jet accelerated flow rate precipitation techniques are preferred for forming monodispersed emulsions. Chemical sensitizing compounds, such as compounds of sulfur, gold, copper, thallium, cadmium rhodium, tungsten, thorium, iridium and mixtures thereof, can be present during precipitation of the silver halide emulsion, as illustrated in U.S. Pat. Nos. 1,195,432; 1,951,933; 2,448,060; 2,628,167; 2,950,972; 3,488,709; and 3,737,313.

The grain size distribution of the silver halide emulsions can be controlled by silver halide grain separation techniques or by blending silver halide emulsions of differing grain sizes. The emulsions can include ammonical emulsions, as illustrated by Glafkides, *Photographic Chemistry*, Vol. 1, Fountain Press, London, 1958, pages 365–368 and pages 301–304; thiocyanate ripened emulsions, as illustrated by U.S. Pat. No. 3,320,069; thioether ripened emulsions as illustrated by U.S. Pat. Nos. 3,271,157; 3,574,628 and U.S. Pat. No. 3,737,313 or emulsions containing weak silver halide solvents, such as ammonium salts, as illustrated by U.S. Pat. No. 3,784,381 and *Research Disclosure*, Vol. 134, Jun. 1975, Item 13452.

The silver halide emulsion can be unwashed or washed to remove soluble salts. The soluble salts can be removed by chill setting and leaching, as illustrated by U.S. Pat. Nos. 2,316,845 and 3,396,027; by coagulation washing, as illustrated by U.S. Pat. Nos. 2,618,556, 2,614,928, 2,565,418, 3,241,969, 2,489,341; and by U.K. Pat. Nos. 1,305,409 and 1,167,159; by centrifugation and decantation of a coagulated emulsion, as illustrated by U.S. Pat. Nos. 2,463,794; 3,707,378, 2,996,287 and 3,498,454; by employing hydrocyclones alone or in combination with centrifuges, as illustrated by U.K. Pat. Nos. 1,336,692, and 1,356,573 and Ushomirski et al *Soviet Chemical Industry*, Vol. 6, No. 3, 1974, pages 181–185; by diafiltration with a semipermeable membrane, as illustrated by *Research Disclosure*, Vol. 102, Oct. 1972, Item 10208; *Research Disclosure*, Vol. 131, Mar. 1975, Item 13122; *Research Disclosure*, Vol. 135, Jul. 1975, Item 13577, German OLS No. 2,436,461 and U.S. Pat. No. 2,495,918; or by employing an ion exchange resin, as illustrated by Maley U.S. Pat. Nos. 2,827,428 and 3,782,953. The emulsions, with or without sensitizers, can be dried and stored prior to use as illustrated by *Research Disclosure*, Vol. 101, Sept. 1972, Item 10152.

The invention is further illustrated by the following examples:

EXAMPLE 1

A series of coatings was made utilizing several concentrations of EAD compounds, as identified above. Each coating contained the amount of EAD noted in the following table and comprised a sulfur plus gold sensitized 0.2 μm cubic AgBrI emulsion (2.6 mol % iodide) with silver coverage at 1.08 g/m$^2$ and gelatin coverage at 4.30 g/m$^2$.

The coatings were exposed for 1 second to a 365 nm mercury line source. The exposed coatings were processed in Developer 1 for 6 minutes at 20° C., followed by processing for 2 minutes at 20° C. in Developer 2 which contained a hydrazine fogging agent. The chemical compositions of the Developers were as follows:

| | |
|---|---|
| **Developer 1** | |
| N-methyl-p-aminophenyl sulfate | 2.0 g |
| Sodium sulfite | 90.9 g |
| Hydroquinone | 8.0 g |
| Sodium carbonate, monohydrate | 52.5 g |
| Potassium bromide | 5.0 g |
| Water, to make | 1 liter |
| **Developer 2** | |
| N-[2-(4-hydrazinophenyl)ethyl]-methanesulfonamide monohydrochloride | 2.1 g |
| Elon | 5 |
| Hydroquinone | 10 g |
| Boric anhydride | 0.2 g |
| Anhydrous $Na_2SO_3$ | 75 g |
| Trisodium phosphate dodecahydrate | 75 g |
| 5-Methylbenzotriazole | 0.2 g |
| NaOH | 8.34 g |
| Water, to make | 1 liter |

TABLE I

| | | | Comparison of Speed/Fog Results for 1 Second 365 nm Line Exposures | | | |
|---|---|---|---|---|---|---|
| EAD No. | Conc mol/mol Ag | $E_R(V)^{(1)}$ | Dev. 1 Relative Speed 0.3 above Fog | Fog | Dev. 2 Relative Speed 0.3 above Fog | Fog |
| — | (Control) | — | 100 | .10 | Fogged to D-max | >1.50 |
| −1 | $1 \times 10^{-7}$ | −.517 | 102 | .07 | 1585 | .21 |
| " | $1 \times 10^{-6}$ | " | 98 | .06 | 1778 | .16 |
| " | $3 \times 10^{-6}$ | " | 95 | .05 | 912 | .18 |
| " | $1 \times 10^{-5}$ | " | 71 | .05 | 4365 | .26 |
| −2 | $1 \times 10^{-7}$ | −.490 | 105 | .05 | 1175 | .20 |
| " | $1 \times 10^{-6}$ | " | 100 | .05 | 1000 | .17 |
| " | $3 \times 10^{-6}$ | " | 81 | .07 | 955 | .16 |
| " | $1 \times 10^{-5}$ | " | 72 | .06 | 1905 | .11 |
| −3 | $1 \times 10^{-7}$ | −.580 | 95 | .06 | 912 | .19 |
| " | $1 \times 10^{-6}$ | " | 91 | .05 | 1445 | .16 |
| " | $3 \times 10^{-6}$ | " | 81 | .05 | 589 | .09 |
| " | $1 \times 10^{-5}$ | " | 60 | .05 | 776 | .08 |
| −4 | $1 \times 10^{-7}$ | −.663 | 87 | .06 | 1413 | .28 |
| " | $1 \times 10^{-6}$ | " | 91 | .05 | 794 | .28 |
| " | $3 \times 10^{-6}$ | " | 81 | .05 | 871 | .15 |
| " | $1 \times 10^{-5}$ | " | 69 | .05 | 631 | .10 |

TABLE I-continued

| EAD No. | Conc mol/mol Ag | $E_R(V)$[1] | Comparison of Speed/Fog Results for 1 Second 365 nm Line Exposures: Dev. 1 Relative Speed 0.3 above Fog | Fog | Dev. 2 Relative Speed 0.3 above Fog | Fog |
|---|---|---|---|---|---|---|
| −5 | $1 \times 10^{-7}$ | −0.360 | 100 | .05 | 1202 | .17 |
| " | $1 \times 10^{-6}$ | " | 102 | .05 | 851 | .23 |
| " | $3 \times 10^{-6}$ | " | 87 | .05 | 219 | .06 |
| " | $1 \times 10^{-5}$ | " | 34 | .05 | 214 | .06 |
| −6 | $1 \times 10^{-7}$ | −0.661 | 68 | .05 | 1047 | .19 |
| " | $1 \times 10^{-6}$ | " | 24 | .06 | 3236 | .19 |
| " | $3 \times 10^{-6}$ | " | 43 | .05 | 1175 | .44 |
| " | $1 \times 10^{-5}$ | " | 17 | .06 | 417 | .16 |
| −7 | $1 \times 10^{-7}$ | −0.401 | 65 | .05 | 2951 | .18 |
| " | $1 \times 10^{-6}$ | " | 49 | .05 | 603 | .06 |
| " | $3 \times 10^{-6}$ | " | 23 | .05 | 209 | .05 |
| " | $1 \times 10^{-5}$ | " | 3 | .06 | 23 | .04 |

[1] $E_R(V)$ is the reversible polarographic reduction potential as defined by J. Lenhard, Journal of Imaging Science, 30, No. 1, 27–35 (Jan/Feb. 1986).

The results in Table I illustrate the speed increases with low fog which are realized when a combination of a fogging developer is used with a coating containing very small amounts of an electron accepting antifogging dye having a polarographic reduction potential more positive than −0.80 volt. This effect can be seen from the antifoggant activity of EAD-7, $E_R = -0.401V$, which requires only $1 \times 10^{-7}$ mol per mol of silver to reduce the fog level from over 1.50 (control) to 0.18. This effect is also seen from activity of EAD-6, having an $E_R$ value of −0.661V, which, at a concentration of only $1 \times 10^{-5}$ mol per mol of silver, reduced the fog level to 0.16.

The speed increases in Table I are also illustrated by comparing EAD-6 at $1 \times 10^{-6}$ mol dye per mol of silver with the undyed control. In Developer #1 the control had a relative speed of 100 whereas in the coating containing EAD-6 at $1 \times 10^{-6}$ mol/mol Ag the speed dropped to 24. However, in Developer #2, containing a hydrazine nucleating agent, the speed was 3236 with a fog of only 0.19.

EXAMPLE 2

The coatings of Example 1 were processed with a nucleating agent in a developer solution. The following illustrates preparation and use of nucleating agents in emulsion layers of a photographic element. Coatings were prepared as follows:

1. Melt 0.1 mol of a silver halide emulsion composed of a 0.2 μm AgBrI cubic emulsion (2.6%I) at 40° C.
2. Add with stirring $4 \times 10^{-5}$ mol of aurous dithiosulfate per Ag mol.
3. Heat with stirring to 70° C. at a rate of 5° C. per 3 minutes and hold at 70° C. for one hour. Cool with stirring to 40° C.
4. Add with stirring 0.3 millimol per Ag mol green sensitizing Dye I and hold 15 minutes at 40° C.
5. Add with stirring 0.3 millimol of red sensitizing Dye II and hold 10 minutes at 40° C.
6. Add with stirring, gelatin to make a solution containing 80 g of gelatin per mol of Ag.
7. Add with stirring varying levels of electron accepting dye EAD-1.
8. Add with stirring 3.257 grains per Ag mol of the nucleating agent 1-formyl-2-{4-[2-(2,4-di-t-amylphenoxy)-butyramido]phenyl} hydrazine (H-11).
9. Add with stirring 0.634 grain per Ag mol of the nucleating agent 1-(4-(2-formyl-hydrazino)phenyl)-3 hexylurea.
10. Add distilled water to a total of 226 kg per Ag mol.
11. Coat on film base at about 3500 mg Ag per square meter.
12. The exposed film was processed for 45 seconds at 29° C. in Developer 3:

| Developer 3 | |
|---|---|
| Hydroquinone | 40.0 g |
| 4,4-Dimethyl-1-phenyl-3-pyrazolidone | 0.4 g |
| 5-Methylbenzotriazole | 0.8 g |
| NaBr | 3.0 g |
| KOH | 14.5 g |
| $NaHCO_3$ | 7.0 g |
| Ethylenediamine tetraacetic acid, sodium salt | 1.0 g |
| $Na_2SO_3$ | 75.0 g |
| Water, to make | 1 liter |

The results of this coating and controls without the indicated addenda are summarized in Table II.

TABLE II

| Coating | Description | Relative Speed | Fog |
|---|---|---|---|
| 1 | Emulsion only, no nucleating agent | 25 | 0.02 |
| 2 | Plus Nucleating agent | 100 | 0.02 |
| 3 | Sulfur and gold sensitization only | 890 | 0.80 |
| 4 | Sulfur and Gold sensitization, plus nucleating agent | 4786 | 1.12 |
| 5 | Sulfur and gold sensitization plus Nucleating agent plus sensitizing dyes | 9333 | 0.63 |
| 6 | Sulfur and gold sensitization plus Nucleating agent plus $6 \times 10^{-6}$ mol/mol Ag of EAD-1 | 3090 | .09 |
| 7 | Sulfur and gold sensitization plus Nucleating agent plus $1.2 \times 10^{-5}$ mol/mol Ag of EAD-1 | 2138 | .05 |

It is seen from Coating 7 that the combination of all addenda yields the best speed and fog results.

Sensitizing Dye #1

Anhydro-5,5'-dichloro-9-ethyl-3,3'-di-(3-sulfopropyl-)oxacarbocyanine hydroxide Na salt:

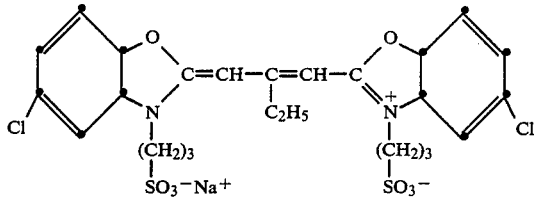

Sensitizing Dye #2

Anhydro-9-ethyl-6,6'-dimethoxy-3,3'-bis(3-sulfopropyl)thiacarbocyanine hydroxide:

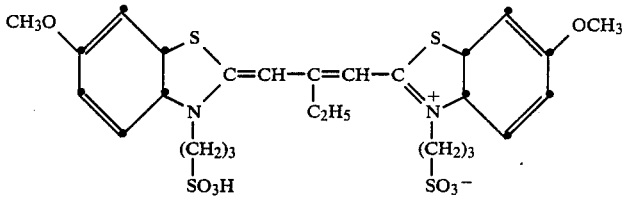

The invention has been described in detail with particular reference to preferred embodiments thereof, but it will be understood that variations and modifications can be effected within the spirit and scope of the invention.

We claim:

1. A photographic element comprising a support having thereon a chemically sensitized, negative working silver halide emulsion layer and a hydrazine compound nucleating agent, wherein said element also comprises an electron accepting antifogging dye which has a reversible reduction potential more positive than about −0.80 volt.

2. An element according to claim 1 wherein the electron accepting antifogging dye has a reversible reduction potential of from about −0.10 to about −0.80 volt.

3. An element according to claim 1 wherein the electron accepting antifogging dye is present at a concentration of from about $10^{-8}$ to about $10^{-3}$ mol/mol of silver.

4. An element according to claim 3 wherein the electron accepting antifogging dye is present at a concentration of from about $10^{-7}$ to about $10^{-4}$ mol/mol of silver.

5. An element according to claim 1 wherein the electron accepting antifogging dye is 1,1'-dimethyl-2,2'-(4-methoxyphenyl)-3,3'-indolocarbocyanine bromide:

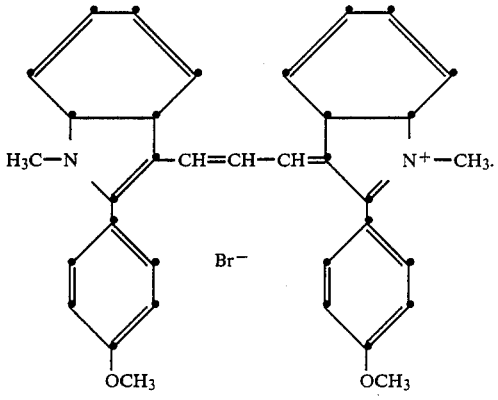

6. An element according to claim 1 wherein the electron accepting antifogging dye is 1,1'-dimethyl-2,2'-diphenyl-3,3'-indolocarbocyanine bromide:

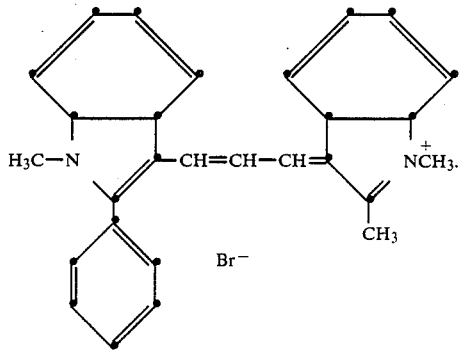

7. An element according to claim 1 wherein the electron accepting antifogging dye is 6,6'-7,7'-tetrachloro-1,1',3,3'-tetraphenyl-1H-imidazo[4,5-b]quinoxalinocarocyanine p-toluenesulfonate:

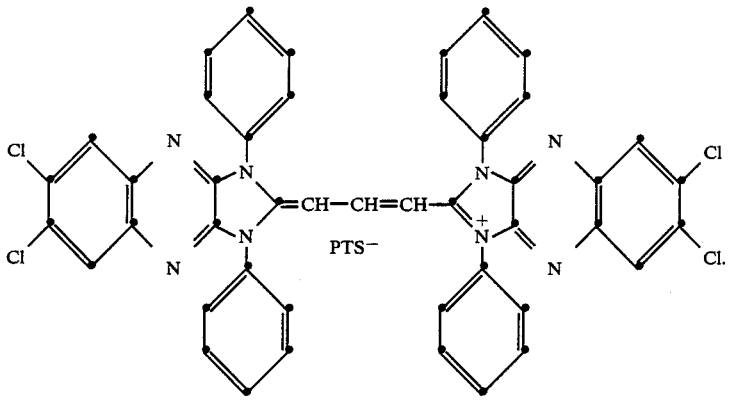

8. An element according to claim 1 wherein the electron accepting antifogging dye is 5-chloro-3-methyl-2-[2-(1-methyl-2-phenyl-1H-indol-3-yl)ethenyl]-6-nitrobenzothiazolium p-toluenesulfonate:

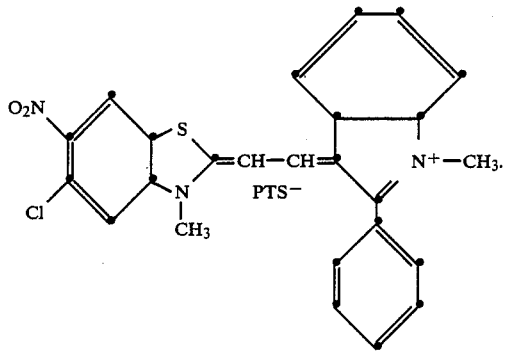

9. An element according to claim 1 wherein the electron accepting antifogging dye is 1,1'-dimethyl-2,2',8-triphenyl-3,3'-indolocarbocyanine perchlorate:

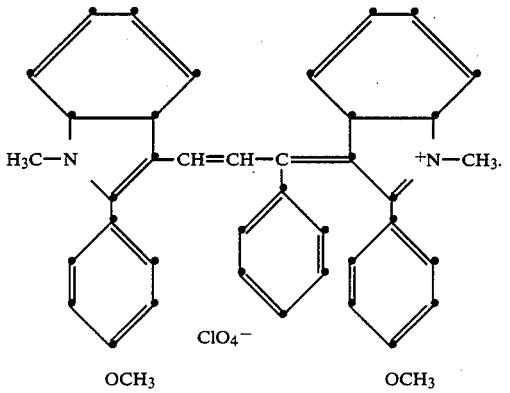

10. An element according to claim 1 wherein the electron accepting antifogging dye is 3-ethyl-2-[2-[1-methyl-2-(2-pyridyl)-1H-indol-3-yl]ethenyl-6-nitrobenzothiazolium p-toluenensulfonate p-toluenesulfonic acid:

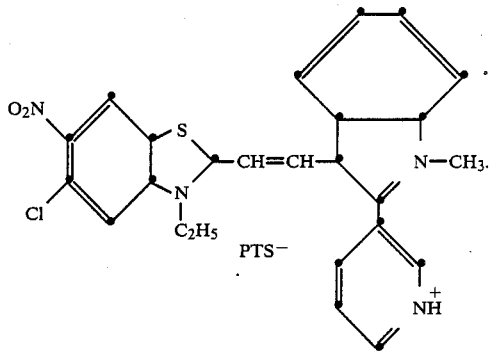

11. An element according to claim 1 wherein the electron accepting antifogging dye is 1,1'-dibutyl-4,4'-bipyridinium dibromide:

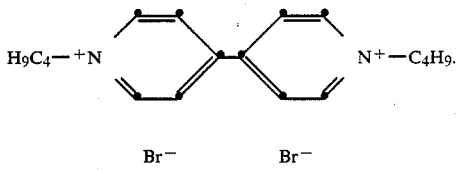

12. An element according to claim 1 wherein the nucleating agent has the structural formula:

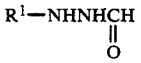

wherein:

$R^1$ is a phenyl nucleus having a Hammet sigma value derived electron withdrawing characteristic of less than +0.30.

13. An element according to claim 1 wherein the nucleating agent has the structural formula:

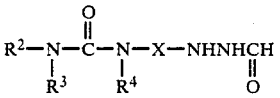

wherein:

$R^2$ and $R^3$ represent hydrogen, an aliphatic group, an aromatic group or a heterocyclic group;

$R^4$ represents hydrogen or an aliphatic group and X is a divalent aromatic group.

14. An element according to claim 1 wherein the nucleating agent has the structural formula:

$$R^5-NHNHCH\underset{O}{\|}$$

wherein $R^5$ is an aliphatic or an aromatic group.

15. An element according to claim 1 wherein the hydrazine compound is present in an amount of from about $10^{-4}$ to about $10^{-1}$ mol per mol of silver.

16. An element according to claim 15 wherein the hydrazine compound is present in an amount of from about $5\times10^{-4}$ to about $5\times10^{-2}$ mol per mol of silver.

17. An element according to claim 1 wherein the silver halide is sulfur and gold sensitized.

18. A chemically sensitized, negative working photographic emulsion comprising a hydrazine compound nucleating agent and an electron accepting antifogging dye having a reversible reduction potential more positive than about −0.80 volt.

19. An emulsion according to claim 18 wherein the electron accepting antifogging dye has a reversible reduction potential of from about −0.10 to about −0.80 volt.

20. An emulsion according to claim 18 wherein the electron accepting antifogging dye is present at a concentration of from about $10^{-8}$ to about $10^{-3}$ mol/mol of silver.

21. An emulsion according to claim 20 wherein the electron accepting antifogging dye is present at a concentration of from about $10^{-7}$ to about $10^{-4}$ mol/mol of silver.

22. An emulsion according to claim 18 wherein the electron accepting antifogging dye is 1,1′-dimethyl-2,2′-(4-methoxyphenyl)-3,3′-indolocarbocyanine bromide

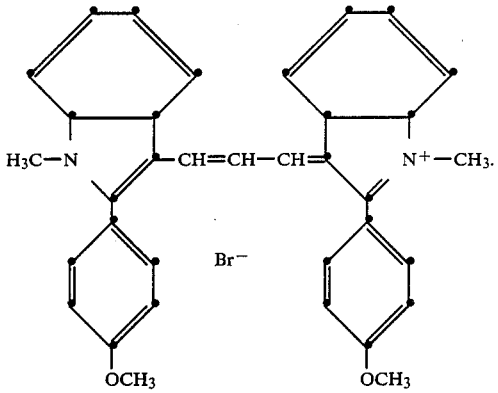

23. An emulsion according to claim 18 wherein the electron accepting antifogging dye is 1,1′-dimethyl-2,2′-diphenyl-3,3′-indolocarbocyanine bromide

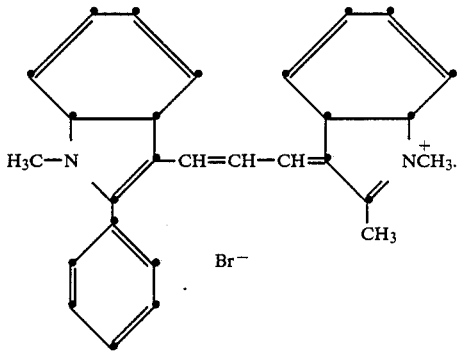

24. An emulsion according to claim 18 wherein the electron accepting antifogging dye is 6,6′-7,7′-tetrachloro-1,1′,3,3′-tetraphenyl-1H-imidazo[4,5-b]quinoxalinocarocyanine p-toluenesulfonate

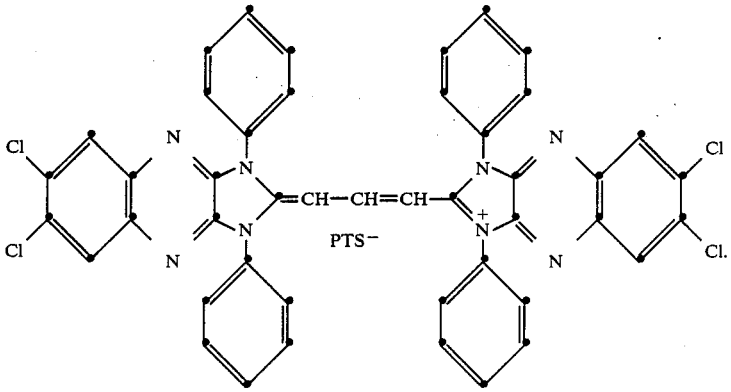

25. An emulsion according to claim 18 wherein the electron accepting antifogging dye is 5-chloro-3-methyl-2-[2-(1-methyl-2-phenyl-1H-indol-3-yl)ethenyl]-6-nitrobenzothiazolium p-toluenesulfonate

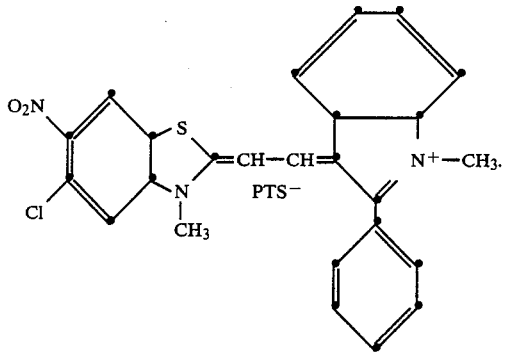

26. An emulsion according to claim 18 wherein the electron accepting antifogging dye is 1,1'-dimethyl-2,2',8-triphenyl-3,3'-indolocarbocyanine perchlorate:

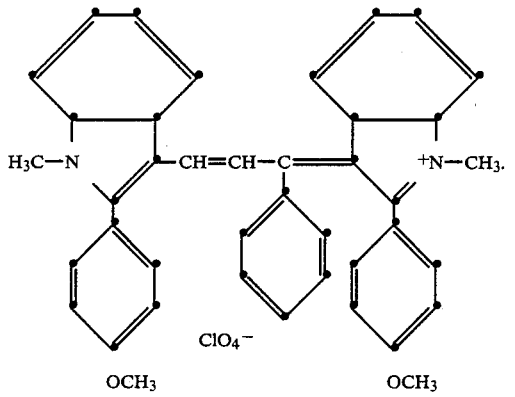

27. An emulsion according to claim 18 wherein the electron accepting antifogging dye is 3-ethyl-2-[2-[1-methyl-2-(2-pyridyl)-1H-indol-3-yl]ethenyl-6-nitrobenzothiazolium p-toluenesulfonate p-toluenesulfonic acid:

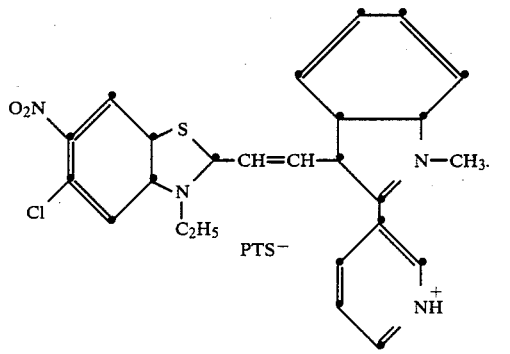

28. An emulsion according to claim 18 wherein the electron accepting antifogging dye is 1,1'-dibutyl-4,4'-bipyridinium dibromide:

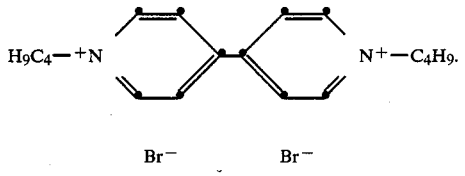

29. An emulsion according to claim 18 wherein the nucleating agent has the structural formula:

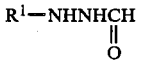

wherein:

$R^1$ is a phenyl nucleus having a Hammet sigma value derived electron withdrawing characteristic of less than +0.30.

30. An emulsion according to claim 18 wherein the nucleating agent has the structural formula:

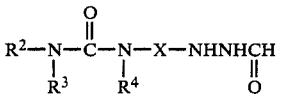

wherein:

$R^2$ and $R^3$ can represent hydrogen, an aliphatic group, an aromatic group or a heterocyclic group;

$R^4$ represents hydrogen or an aliphatic group and

X is a divalent aromatic group.

31. An emulsion according to claim 18 wherein the nucleating agent has the structural formula:

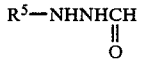

wherein $R^5$ is an aliphatic or an aromatic group.

32. An emulsion according to claim 18 wherein the hydrazine compound is present in an amount of from about $10^{-4}$ to about $10^{-1}$ mol per mol of silver.

33. An emulsion according to claim 18 wherein the hydrazine compound is present in an amount of from about $5\times10^{-4}$ to about $5\times10^{-2}$ mol per mol of silver.

34. An emulsion according to claim 18 wherein the silver halide is sulfur and gold sensitized.

35. A process for forming an image which comprises image-wise exposing to light a photographic light-sensitive material comprising a support having thereon a chemically sensitized, negative working silver halide emulsion and an electron accepting antifogging dye which has a reversible reduction potential more positive than about −0.80 volt and developing said exposed photographic light-sensitive material with a developing solution containing a hydrazine compound nucleating agent.

36. The process of claim 35 wherein the hydrazine compound is present in an amount of from about $10^{-5}$ to about $10^{-2}$ mol thereof per liter of developer solution.

37. The process of claim 35 wherein the nucleating agent has the structural formula:

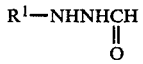

wherein:

$R^1$ is a phenyl nucleus having a Hammet sigma value derived electron withdrawing characteristic of less than +0.30.

38. The process of claim 35 wherein the nucleating agent has the structural formula:

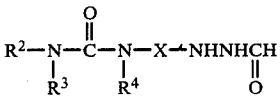

wherein:

$R^2$ and $R^3$ can represent hydrogen, an aliphatic group, an aromatic group or a heterocyclic group;

$R^4$ represents hydrogen or an aliphatic group and

X is a divalent aromatic group.

39. The process of claim 35 wherein the nucleating agent has the structural formula:

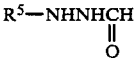

wherein $R^5$ is an aliphatic or an aromatic group.

* * * * *